US007181775B2

(12) United States Patent
Carney

(10) Patent No.: US 7,181,775 B2
(45) Date of Patent: Feb. 27, 2007

(54) MATERNITY GARMENT

(76) Inventor: Ingrid Carney, 990 Corbett Ave., San Francisco, CA (US) 94131

( * ) Notice: Subject to any disclaimer, the term of this patent is extended or adjusted under 35 U.S.C. 154(b) by 220 days.

(21) Appl. No.: 10/423,224

(22) Filed: Apr. 25, 2003

(65) Prior Publication Data

US 2004/0210987 A1 Oct. 28, 2004

(51) Int. Cl.
*A41D 1/20* (2006.01)

(52) U.S. Cl. ..... 2/311; 2/338

(58) Field of Classification Search ..... 2/464, 2/44, 106, 48, 104, 217, 218, 219, 220, 221, 2/244, 311, 321, 338, 227, 69, 400, 406, 409, 2/73, 80; D2/627; 450/155, 1, 30, 31, 37, 450/58, 110, 120–123, 127, 128; 602/19
See application file for complete search history.

(56) References Cited

U.S. PATENT DOCUMENTS

| | | | | | |
|---|---|---|---|---|---|
| 404,163 | A | * | 5/1889 | Brunner | 2/338 |
| 482,401 | A | * | 9/1892 | Tynan | 2/338 |
| 514,930 | A | * | 2/1894 | Heath | 450/155 |
| 818,031 | A | * | 4/1906 | Kislik | 2/338 |
| 836,136 | A | * | 11/1906 | Parris | 2/236 |
| 1,380,605 | A | * | 6/1921 | Swantees | 2/115 |
| 1,389,664 | A | | 9/1921 | Jackson | |
| 1,608,096 | A | | 11/1926 | Friedman | |
| 1,609,248 | A | * | 11/1926 | Harkins | 450/134 |
| 1,753,739 | A | * | 4/1930 | Burns | 450/110 |
| 2,574,678 | A | * | 11/1951 | Wilbur | 2/301 |
| 2,723,396 | A | * | 11/1955 | Stack | 450/58 |
| 2,787,792 | A | * | 4/1957 | Mikottis | 2/221 |
| 2,878,812 | A | * | 3/1959 | Geimer | 450/118 |
| 3,087,496 | A | * | 4/1963 | Norman | 450/155 |
| 3,089,149 | A | | 5/1963 | Kelleam | |
| 3,431,562 | A | | 3/1969 | Soulders | |

(Continued)

FOREIGN PATENT DOCUMENTS

| | | |
|---|---|---|
| JP | 1148802 | 6/1989 |

(Continued)

OTHER PUBLICATIONS

Happers Bazaar, Nov. 1952, p. 98, Cinch Belts, Dorothy Huges.*

(Continued)

*Primary Examiner*—Alissa L. Hoey
(74) *Attorney, Agent, or Firm*—Thomas M. Freiburger

(57) ABSTRACT

Maternity wear of the invention accommodates the changing shape of a woman's body during pregnancy, minimizing the need for maternity clothes. In one aspect of the invention, pants or a skirt are worn with the upper end unfastened so as to conform to the shape of the swelling torso in pregnancy, and an elastic band shaped similarly to a tube top is worn generally around the waist, so as to overlap the top of the unfastened pants or skirt and retain them on the body. A top, such as a blouse or shirt, can be worn with its tail end extending over the band. In another aspect of the invention, too-large maternity clothing is worn with the band garment engaged over the upper end. If desired the band garment can be folded over on itself, thus doubling its thickness.

15 Claims, 12 Drawing Sheets

U.S. PATENT DOCUMENTS

| | | | | | |
|---|---|---|---|---|---|
| 3,487,418 | A | | 12/1969 | Jacobs | |
| 3,490,449 | A | * | 1/1970 | Ewerwahn | 450/155 |
| 3,505,685 | A | | 4/1970 | Granchelli | |
| 3,623,488 | A | | 11/1971 | Nakayama | |
| 3,793,645 | A | | 2/1974 | Kadison | |
| 3,936,075 | A | * | 2/1976 | Jelliffe | 280/751 |
| 4,280,229 | A | * | 7/1981 | Stein | 2/221 |
| 4,472,839 | A | * | 9/1984 | Johansen | 2/338 |
| 4,506,390 | A | * | 3/1985 | Stern | 2/221 |
| 4,523,337 | A | | 6/1985 | Leibowitz | |
| 4,527,402 | A | | 7/1985 | Swallow et al. | |
| 4,557,268 | A | | 12/1985 | Maddux | |
| 4,580,298 | A | | 4/1986 | Tuisl | |
| 4,596,253 | A | | 6/1986 | Griffith | |
| 4,620,326 | A | | 11/1986 | Matthias, Jr. | |
| 4,697,592 | A | | 10/1987 | Maddux | |
| 4,803,740 | A | * | 2/1989 | Dawson | 2/215 |
| 4,849,863 | A | * | 7/1989 | Gallegos | 362/108 |
| 4,952,192 | A | | 8/1990 | Burke | |
| 4,976,653 | A | * | 12/1990 | White | 450/155 |
| 5,060,639 | A | * | 10/1991 | Marcus | 602/19 |
| 5,144,696 | A | * | 9/1992 | Kahl | 2/207 |
| 5,163,184 | A | | 11/1992 | Reardon | |
| 5,283,910 | A | | 2/1994 | Flint | |
| 5,406,964 | A | * | 4/1995 | Calleja | 128/888 |
| 5,416,928 | A | * | 5/1995 | Koenig | 2/244 |
| 5,492,496 | A | * | 2/1996 | Walker | 450/155 |
| 5,575,011 | A | * | 11/1996 | Allen | 2/227 |
| 5,611,084 | A | * | 3/1997 | Garry et al. | 2/93 |
| 5,690,122 | A | * | 11/1997 | Weber-Unger | 128/876 |
| 5,743,783 | A | | 4/1998 | Weber-Unger | |
| 5,787,512 | A | | 8/1998 | Knox | |
| 5,902,170 | A | * | 5/1999 | Ganz | 450/94 |
| 5,913,410 | A | * | 6/1999 | Tsuchiya | 2/311 |
| 5,915,531 | A | * | 6/1999 | Hilpert et al. | 2/69 |
| 5,946,730 | A | * | 9/1999 | Blair | 2/227 |
| 5,956,765 | A | | 9/1999 | Chin | |
| 6,048,253 | A | * | 4/2000 | Larsen | 450/155 |
| 6,061,832 | A | * | 5/2000 | Morrison, Jr. | 2/78.1 |
| 6,062,946 | A | * | 5/2000 | Rosenberg | 450/155 |
| 6,071,175 | A | * | 6/2000 | Working, III | 450/155 |
| D427,748 | S | | 7/2000 | Shackelford | |
| 6,085,356 | A | * | 7/2000 | Redmond, Sr. | 2/237 |
| 6,219,848 | B1 | * | 4/2001 | Russell | 2/221 |
| 6,276,175 | B1 | | 8/2001 | Browder | |
| 6,292,950 | B1 | | 9/2001 | Mentone | |
| 6,322,529 | B1 | | 11/2001 | Chung | |
| 6,620,026 | B1 | * | 9/2003 | Guilani et al. | 450/155 |
| 6,672,311 | B2 | * | 1/2004 | Rindfleish | 128/874 |
| 2004/0049834 | A1 | * | 3/2004 | Stangle et al. | 2/338 |
| 2004/0163159 | A1 | * | 8/2004 | Edwards et al. | 2/338 |

FOREIGN PATENT DOCUMENTS

| | | |
|---|---|---|
| JP | 8089521 | 4/1996 |
| JP | 10266002 | 10/1998 |
| JP | 2002088518 | 3/2002 |
| JP | 2002317311 | 10/2002 |
| NZ | 337903 | 4/2002 |

OTHER PUBLICATIONS http://www.mytiesarongs.com/tubetops.htm, My Ties, Cotton stretch tube top, Mar. 2001.*

The Notion and Novely Review, Aug. 1936, Belts, Make the Silhouette.* www.inthe80s.com, Units description, Jun. 2, 2002.* www.netrags.com/fashionshow.htm, Multiples photos and descriptions, Mar. 6, 2000.*

Belly Belt, Maternity Wear Solution, Australia.

*New York Observer,* Apr. 12, 1999, "Struggling for a Fashion-Forward Pregnancy", p. 26, with abstract showing date of publication.

Kiabi, description and view of Bandeau Mater (maternity belt), print from Kiabi.com website, copyright 2001, with English translation, two pages.

* cited by examiner

MATERNITY GARMENT

BACKGROUND OF THE INVENTION

This invention concerns maternity apparel, and specifically relates to a stretchable garment which can be worn in such a way as to allow pants, shorts or a skirt to be left open at the waist, or allow a woman to wear oversized maternity pants or skirts without falling off or appearing too large, bulky or awkward, to accommodate changes in the shape of the body during pregnancy and afterwards.

The shape of a woman's body changes dramatically during pregnancy, and even after pregnancy, can require considerable time and effort to return to normal. In particular, the pregnant woman's belly goes through several phases, expanding and retracting over a period of time which is relatively short in comparison to non-pregnancy related weight gains and loses. At some point the pregnant woman is unable to wear her normal clothes, particularly pants and skirts, which can no longer be fastened. Various maternity clothes are available but even with these specialized items, the continued changes in the shape of the pregnant woman often result in items of such clothing being useful for only short periods of time. While the maternity apparel industry has responded to some extent by developing new designs intended to expand and retract with the pregnant and post-pregnancy changes, the results are often not satisfactory.

Generally, noticeable changes start in early pregnancy when a woman's belly begins to show, causing her pants and skirt to feel tighter around the waist. This stage is called transition. The woman may try rudimentary solutions to fasten clothes without the normal closure at the waist, or may buy pants and skirts one or several sizes larger than her pre-pregnancy size for this temporary phase, but such clothing is nonetheless ill-fitting. On top of this, the continued tumescence over the following weeks will make moot these temporary measures. There are few practical solutions for this transition stage.

At the end of the transition stage, the pregnant woman resorts to maternity clothes. However, it is often the case that her belly cannot fill most maternity garments (18–26 week range). Maternity apparel is generally manufactured for an average-sized woman in her seventh month of pregnancy (about 30 weeks). Typically a panel garment made for bottom-half maternity wear remains too large until the woman is well into her second trimester, or entering her third trimester (22–32 week range). Available maternity clothing is usually too loose at this stage, and the pregnant woman typically wears excess fabric around her belly, appearing bulky and unattractive underneath her blouses, sweaters and T-shirts.

Only in about the 30–40 week range does the body typically fill and wear well the available maternity clothing.

After delivery, the woman's body continues its metamorphosis as it reshapes into its normal size over weeks or months. Finding clothes to fit properly requires considerable creativity. At most stages the maternity clothing, oversized regular clothing or the normal size regular clothing will be ill-fitting, either too tight, too loose, too bulky, and/or awkward and unattractive.

In the prior art, these problems have been addressed in various ways. See U.S. Pat. Nos. 6,276,175, 6,219,848, 6,085,356, 5,946,730, 5,902,170, 5,787,512, 5,492,496, 5,283,910, 5,163,184, 4,976,653, 4,952,192, 4,803,740, 4,697,592, 4,596,253, 4,580,298, 4,557,268, 4,523,337, 4,280,229, 3,431,562, 3,089,149, 2,787,792, 1,608,096, 1,389,664 and DES 427,748. Of these patents, Tuisl U.S. Pat. No. 4,580,298 shows a waistband extender allowing the pants to be worn open, but with an elastic strip connecting to the waistband at the top so as to allow an expanded size at the waist; Redmond U.S. Pat. No. 6,085,356 is similar. Mikottis U.S. Pat. No. 2,787,792 shows a maternity skirt with an elastic insert in the area needing additional room; Stein U.S. Pat. No. 4,280,229 is somewhat similar. Ganz U.S. Pat. No. 5,902,170 merely shows a band worn as an undergarment, to give the body a more pleasing shape. Souders U.S. Pat. No. 3,431,562 and Kelleam U.S. Pat. No. 3,089,149 show skirts that can be re-shaped with insert panels to provide for a larger waist.

Similar to the devices in some of the above patents is the product "Belly Belt", made in Australia and marketed online by Motherhood Maternity. The product is a simple fabric panel about seven inches wide, with a belt channel formed along the top edge to receive an included elastic belt. The pants or skirt are worn open, with the panel tucked behind to cover the open area and the elastic belt secured by button and buttonhole connected to existing buttonhole and button the pants or skirt.

Nothing in the prior art shows or suggests the approach of the present invention, by which the pregnant woman's normal clothes can be worn, throughout much of the pregnancy, in a comfortable and attractive manner.

SUMMARY OF THE INVENTION

During pregnancy, in one embodiment of the invention, a woman wears her pants (the term pants includes shorts) or skirt unfastened at the top, to the degree needed, and wears a stretchable generally cylindrical garment, similar to a "tube top", over the waist in such a way as to overlap the unfastened top end of the pants or skirt. In addition to covering the unfastened upper area of the lower garment, the band of the invention holds the pants or skirt in place on the body. A shirt or blouse can be worn extending over the band. The result is an assembled and neat appearance which, although not hiding the fact of pregnancy, avoids ill-fitting clothing and a bulky, awkward or unattractive appearance. In another aspect of the invention a pregnant woman wears the band garment over an oversized maternity garment (pants or skirt), covering and pressing down excess fabric to eliminate bulkiness while retaining the bottom garment in place.

The invention is principally embodied in a method for accommodating changes in the shape of a woman during pregnancy without the need for a series of different-size maternity clothes. This method, in one form, includes providing a band of flexible, stretchable material, which may be generally cylindrical in shape and in a size so as to be expanded and stretched to be worn around a pregnant woman's torso approximately at the waist. The pregnant woman wears the elastic band over pants or a skirt which has become too tight to accommodate the swelling of the belly during pregnancy, by wearing the pants or skirt unfastened and stretching and placing the elastic band over an upper portion and upper edge of the pants or skirt. In addition, the elastic band is worn over oversized maternity clothes which the woman's pregnant belly does not yet fill. The band, again, is worn over an upper portion and upper edge of the pants or skirt.

The method preferably may include wearing the band such that a portion of the height of the band resides over the pants or skirt, while an upper portion of the band's height extends above the upper edge of the pants or skirt and engages against the torso. In addition, if desired the woman may wear the band such that it covers the bottom or tail end of a top, such as a shirt or blouse, although normally the top garment would extend down over the band.

The elastic band, if desired, may be worn as a single layer residing over the pants or skirt, or folded in half as a double layer, providing an additional layer to further conceal bulky and cumbersome fabric, increasing tension slightly.

The band garment of the invention preferably is formed of smooth knit fabric which, with the elastic in the fabric, comfortably hugs a woman's lower abdomen, flattening and shaping any fabric underneath, such as unfastened buttons and zippers or excess fabric from large maternity wear she does not fill. The woman can wear her normal pre-pregnancy clothes longer and maternity clothes sooner, as the band garment transforms bulky and cumbersome fabric to appear as well-fitted apparel. The result is a shapely and smooth belly surface that is both comfortable and attractive. Wearing the band garment the woman can wear form-fitting tops, shirts and sweaters without the bulky fabric of unfastened closures or excess maternity fabric bulging over the belly and through the tops. After pregnancy, a new mother can use the band garment to transition from maternity wear to normal, pre-pregnancy clothes as the body reshapes itself. If the woman's untucked top rises to expose her belly, only the band garment will be visible, appearing as part of the clothing worn.

It is thus among the objects of the invention to provide an improved garment and procedure for accommodating the changes in a woman's shape during pregnancy. This and other objects, advantages and features of the invention will be apparent from the following description of a preferred embodiment, considered along with the accompanying drawings.

DESCRIPTION OF PREFERRED EMBODIMENTS

Figure 1:
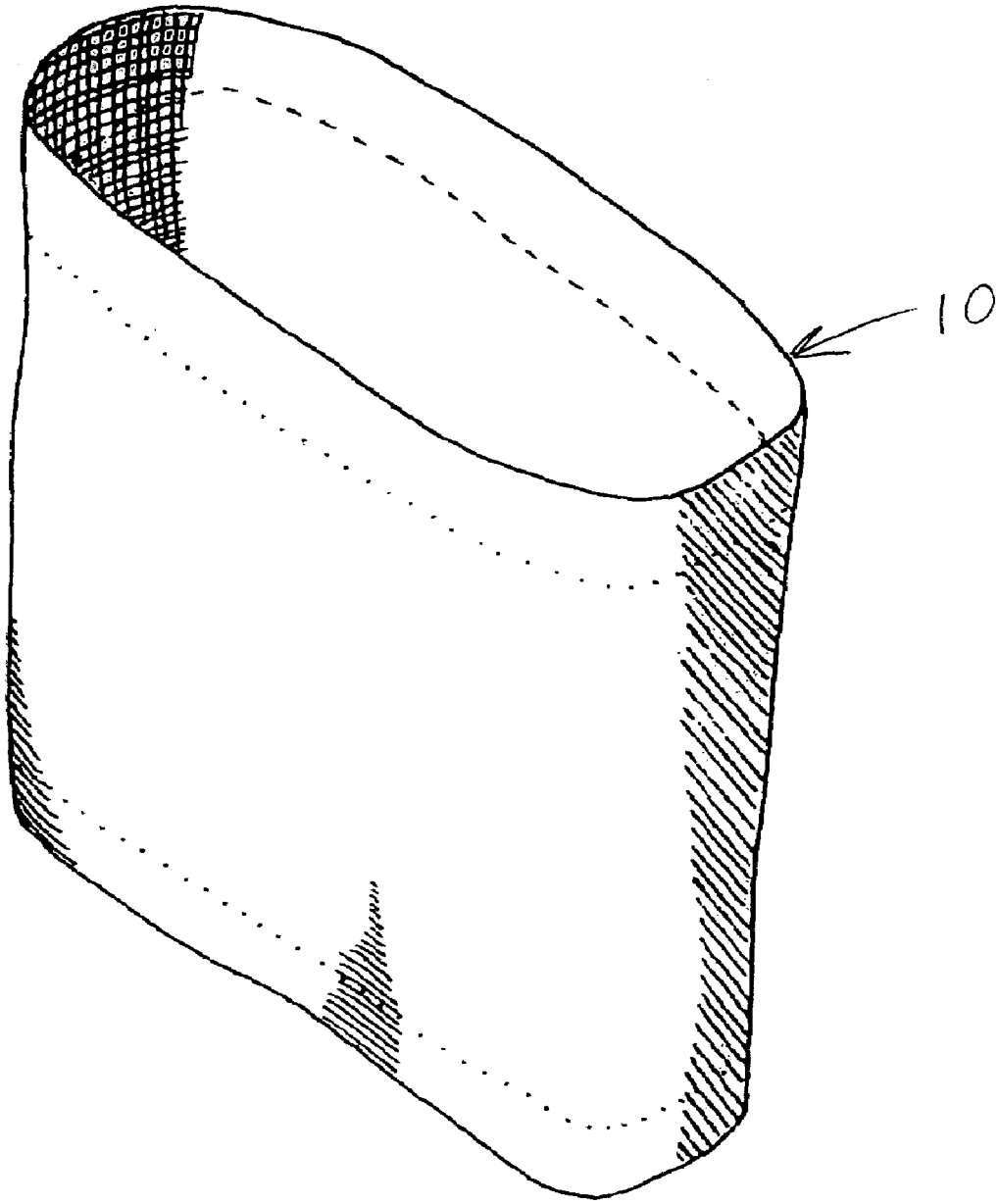
FIG. 1 is a perspective view showing a band garment for pregnant women, according to the invention.

In the drawings, FIG. 1 shows a band garment 10 embodying the principles of the invention. The band garment 10 is preferably about six to twelve inches in height, more preferably about ten to twelve inches, and of a circumference which will accommodate a pregnant woman of a designated size range, the circumference preferably being between 20 and 30 inches. The garment is of stretchable material, and can be designed such that one size fits most users, although two or three different sizes can be provided if desired, for different sizes of women. It is intended that a garment band 10 of a single size will fit a particular pregnant woman throughout the period of time when she cannot wear her normal clothing, or is too small for maternity wear.

In a preferred embodiment the band garment 10 is of smooth knit fabric, in basic colors typical of bottom-half clothing today: black, khaki, denim-color blue, and white. It can also be made in various and seasonal patterns and colors if desired. The garment may be seamless (or it can be seamed) and of stretchable, breathable knit Nylon/Lycra Spandex blend.

Figure 2:
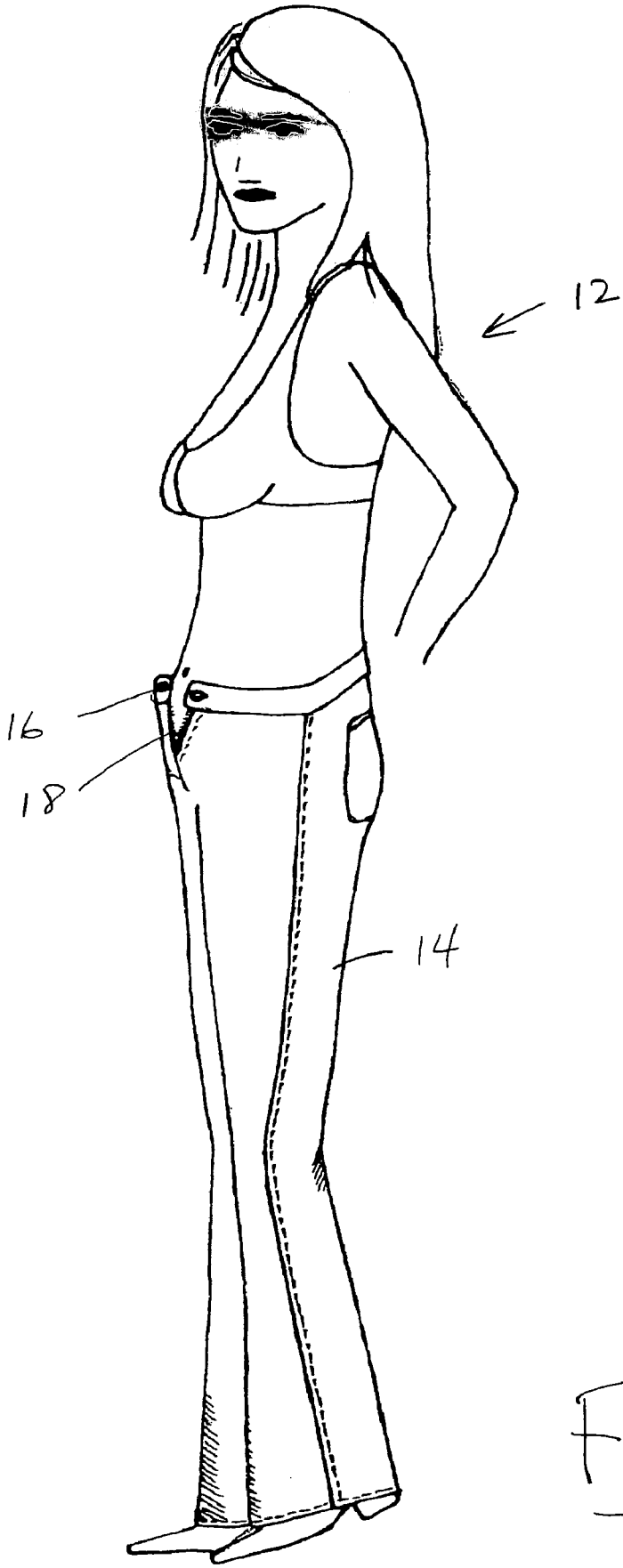
FIG. 2 is a view showing a pregnant woman wearing pre-pregnancy pants, unfastened so as to accommodate the enlarged shape of the belly.

FIG. 2 shows a pregnant woman 12 who is wearing her normal pre-pregnancy pants 14, but is unable comfortably to fasten the button 16 and zipper 18 at the top of the pants. However, the portion below the belly still fits comfortably, and the garment 14 fits reasonably well with the fastenings left open, as shown.

Figure 3:
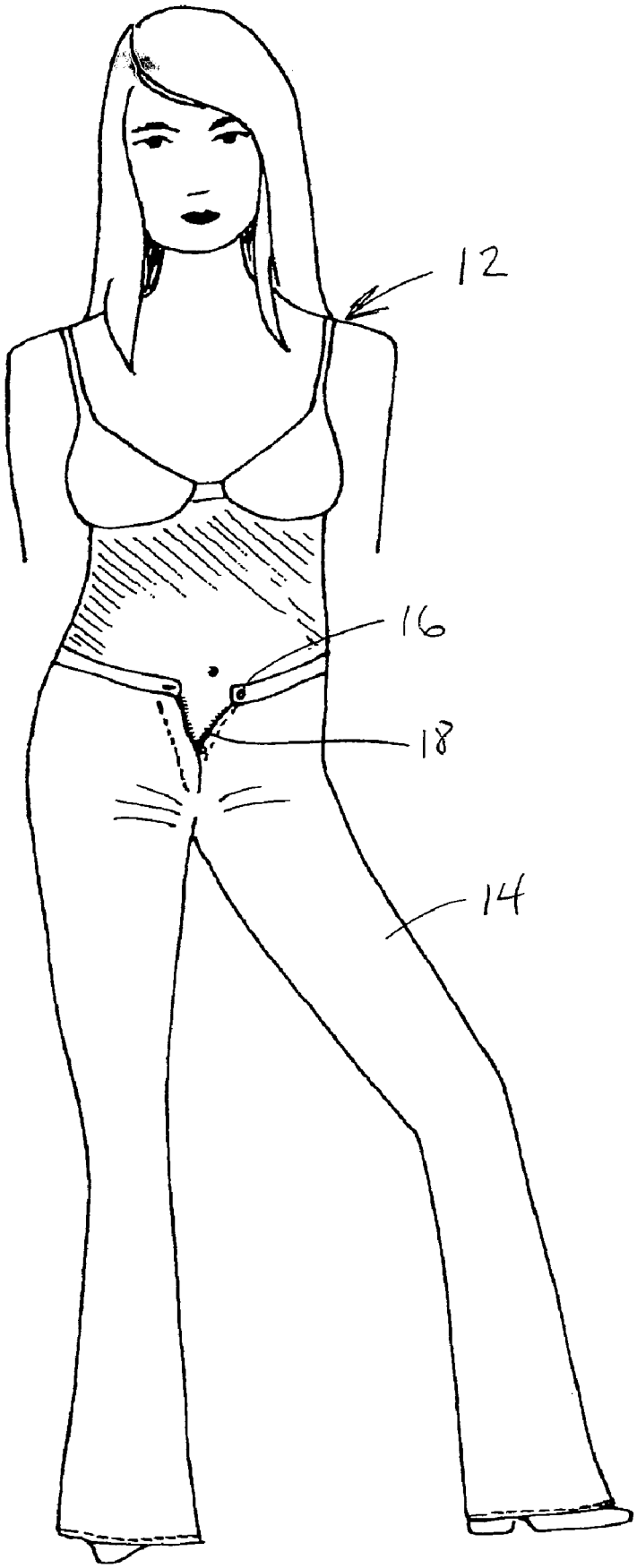
FIG. 3 is a frontal view of what is shown in FIG. 2.

FIG. 3 is a frontal view of the same pregnant woman 12, with the pants 14 shown opened as in FIG. 2. This, of course, is not a complete solution to her problem, because the pants need some means of being retained in position and because, if she simply wears a top sized to extend down over the open top of the pants, as in FIG. 4A, this appears bunched and bulky and awkward, as FIG. 4A illustrates at 20.

Figure 4:
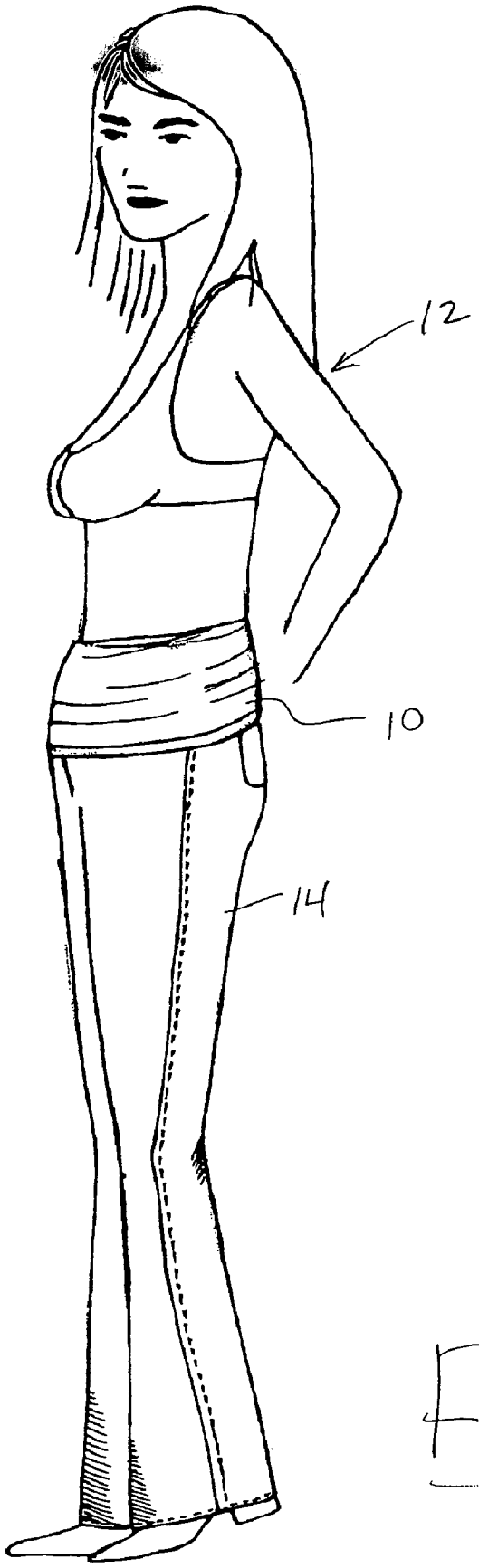
FIG. 4 is a view showing the pregnant woman wearing the band garment approximately at the waist, overlapping the unfastened pants so as to cover the open pants top and to retain the pants on the body.
Figure 4A:
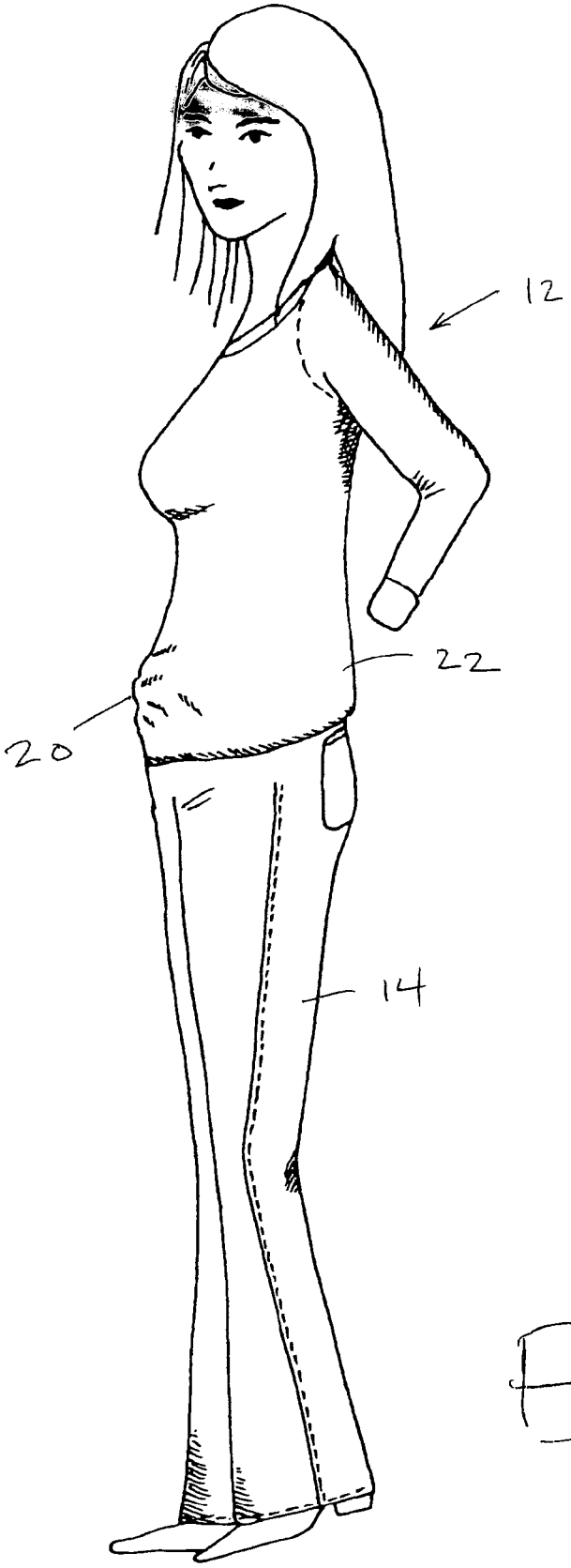
FIG. 4A is a view similar to FIG. 4, but showing the pregnant woman wearing pants as in FIGS. 2 and 3 without the band garment of the invention, with a top covering the upper end of the pants.

FIG. 4 shows the solution provided by the band garment 10 of the invention. As shown, the stretchable band 10 engages somewhat firmly but comfortably over the top of the woman's skirt or pants 14 in the opened condition, holding the zipper, button and flaps closely and flatly and avoiding any bulkiness or awkward appearance.

Figure 4B:
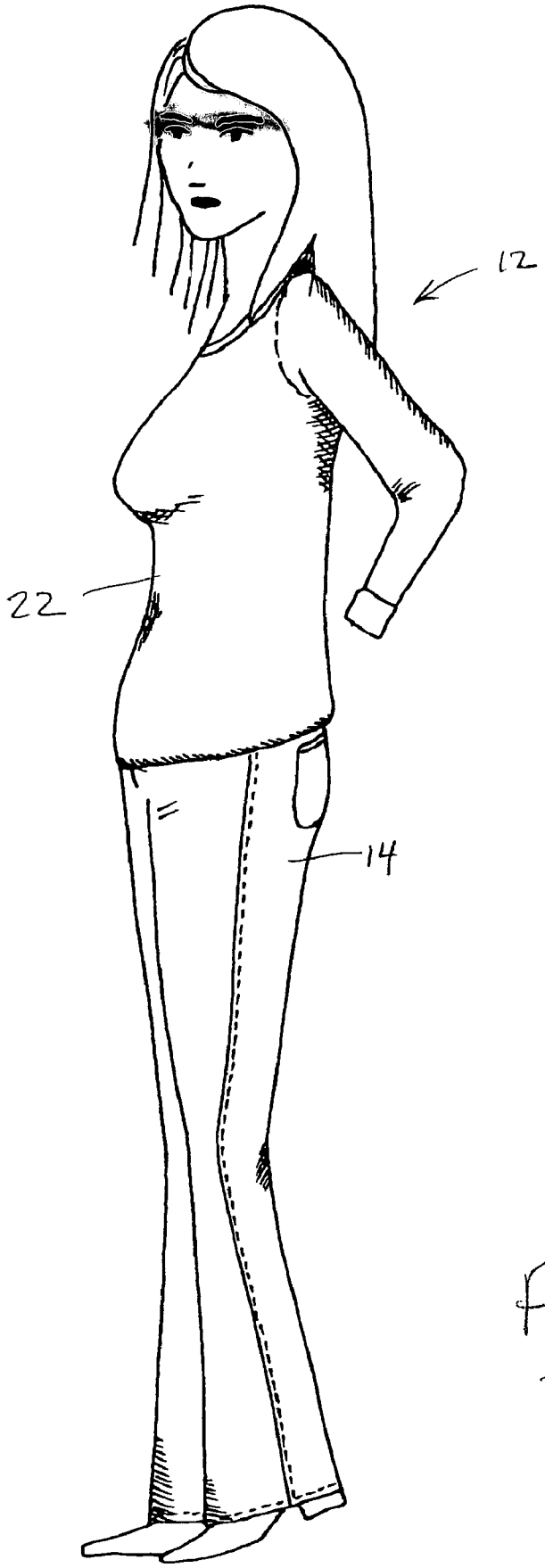
FIG. 4B is a view similar to FIG. 4 showing the pregnant woman's appearance wearing the band garment of the invention, with a top covering the band garment.
Figure 5:
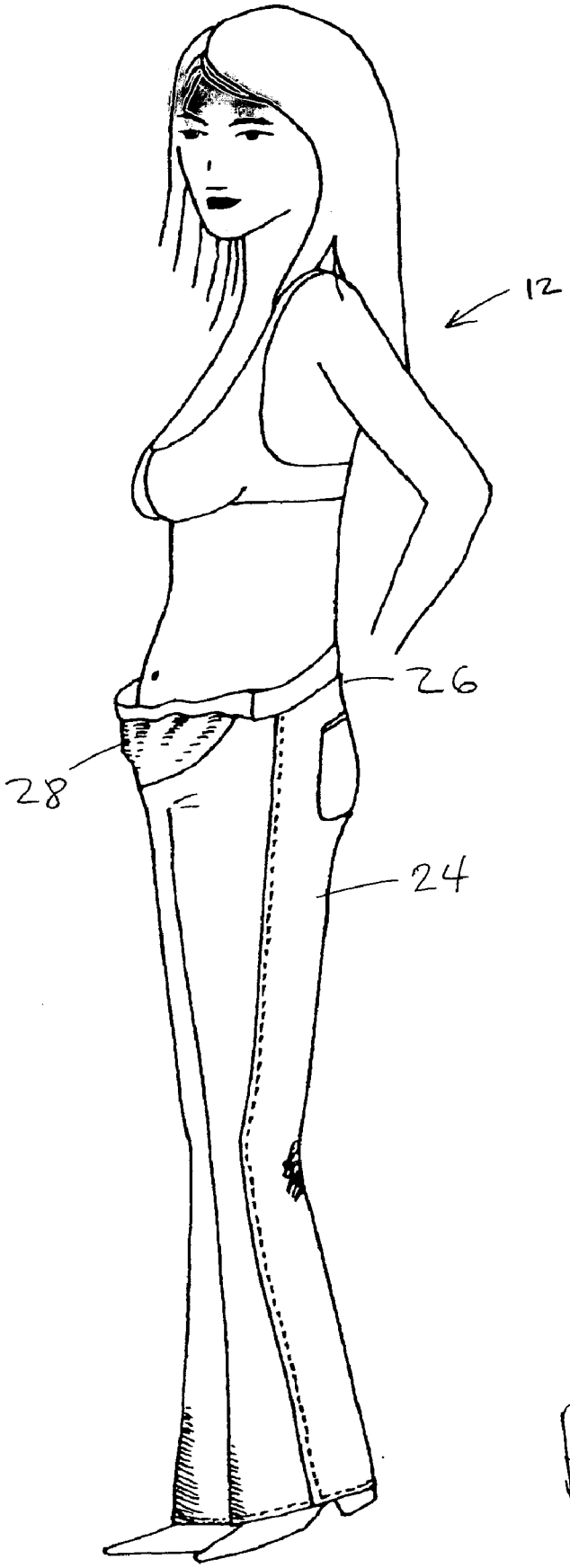
FIG. 5 is a view showing a pregnant woman wearing maternity pants, which are too large at the waist for her current condition.
Figure 6:
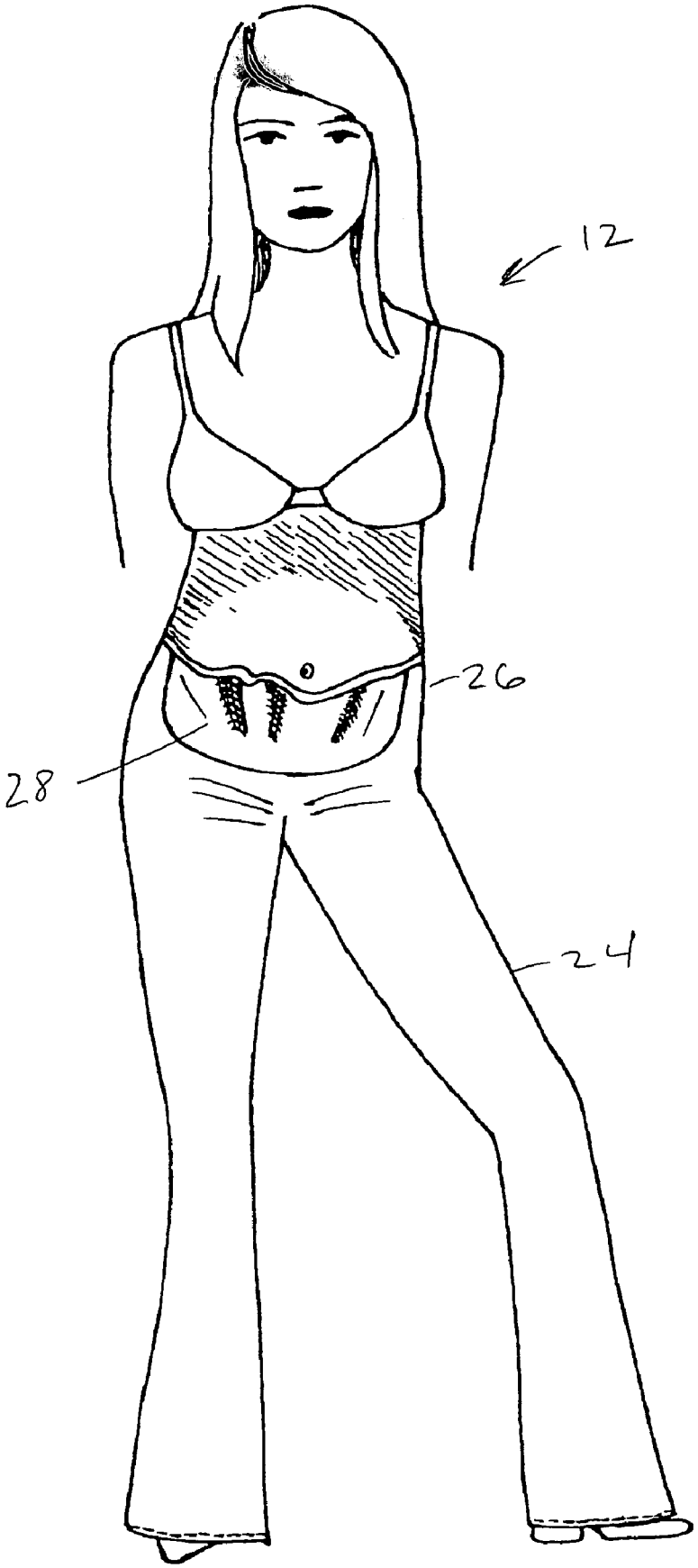
FIG. 6 is a frontal view of what is shown in FIG. 5.

FIG. 4B shows the woman 12 wearing the band garment as in FIG. 4, but with a top 22 down over the band garment and contacting the pants 14. As illustrated, the bulky and awkward appearance is eliminated.

Figure 7:
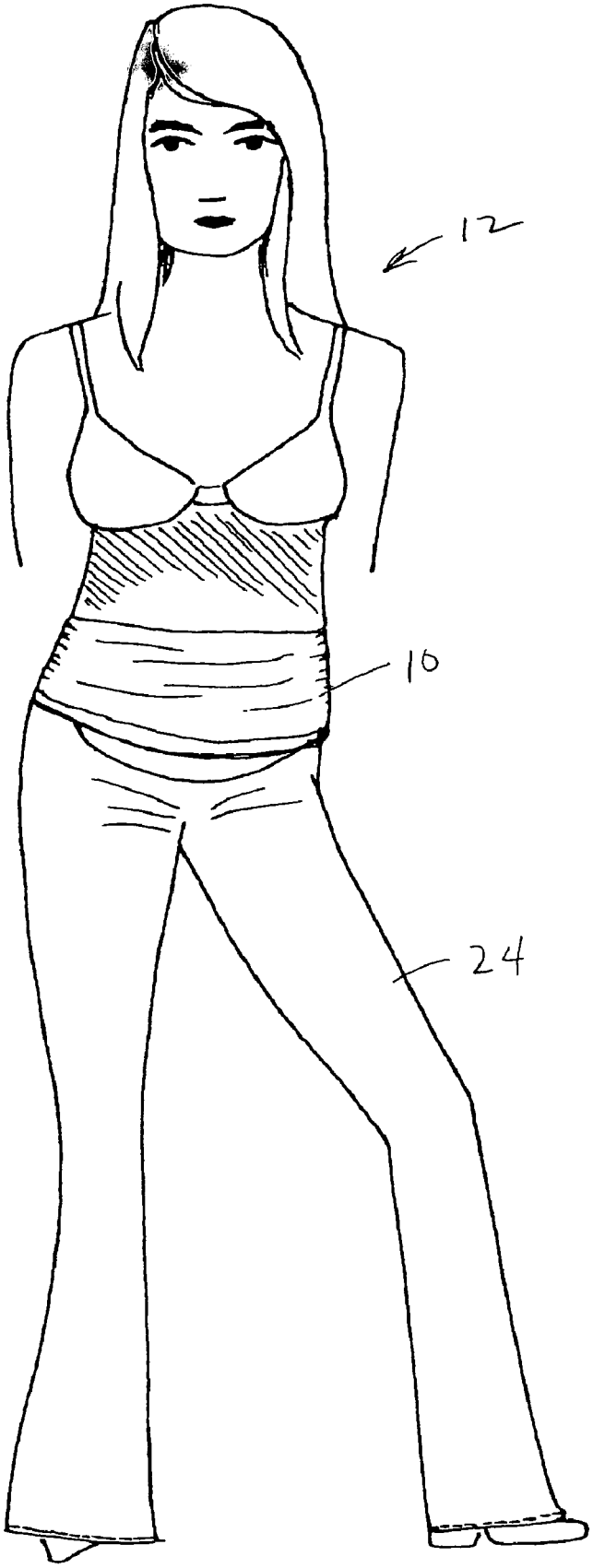
FIG. 7 is a view similar to FIG. 4, but showing a pregnant woman wearing oversized maternity clothing as in FIGS. 5 and 6, retained in position by the band garment of the invention.
Figure 7A:
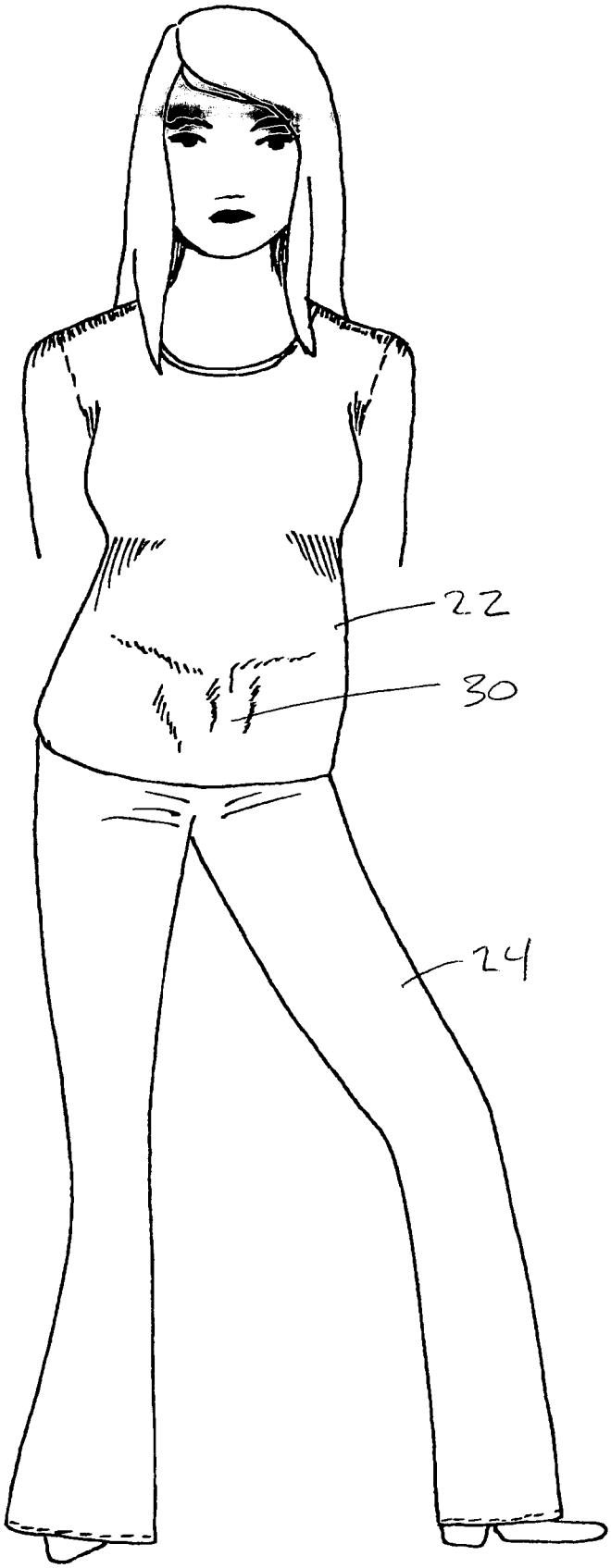
FIG. 7A is a view similar to FIG. 7 showing the pregnant woman wearing loose maternity clothing as in FIGS. 5 and 6, covered by a top, and without the band garment of the invention.

FIGS. 5, 6, 7, 7A and 7B show the pregnant woman 12, at about the same stage of pregnancy as in the earlier figures, wearing maternity clothing 24 which is too large for this stage of pregnancy. The pants shown in FIG. 5 have a waist 26 which is expanded from a normal waist size commensurate with pants of this size, and may have a stretchable expansion panel in the front as shown at 28. The same maternity clothing is shown on the woman in frontal view in FIG. 6. FIG. 7A shows the effect of simply wearing a top 22, i.e. a shirt or blouse, over the oversized and loose waist portion of the pants or skirt 24. This gives a lumpy, bunched, awkward appearance, especially at the frontal area 30.

Figure 7B:
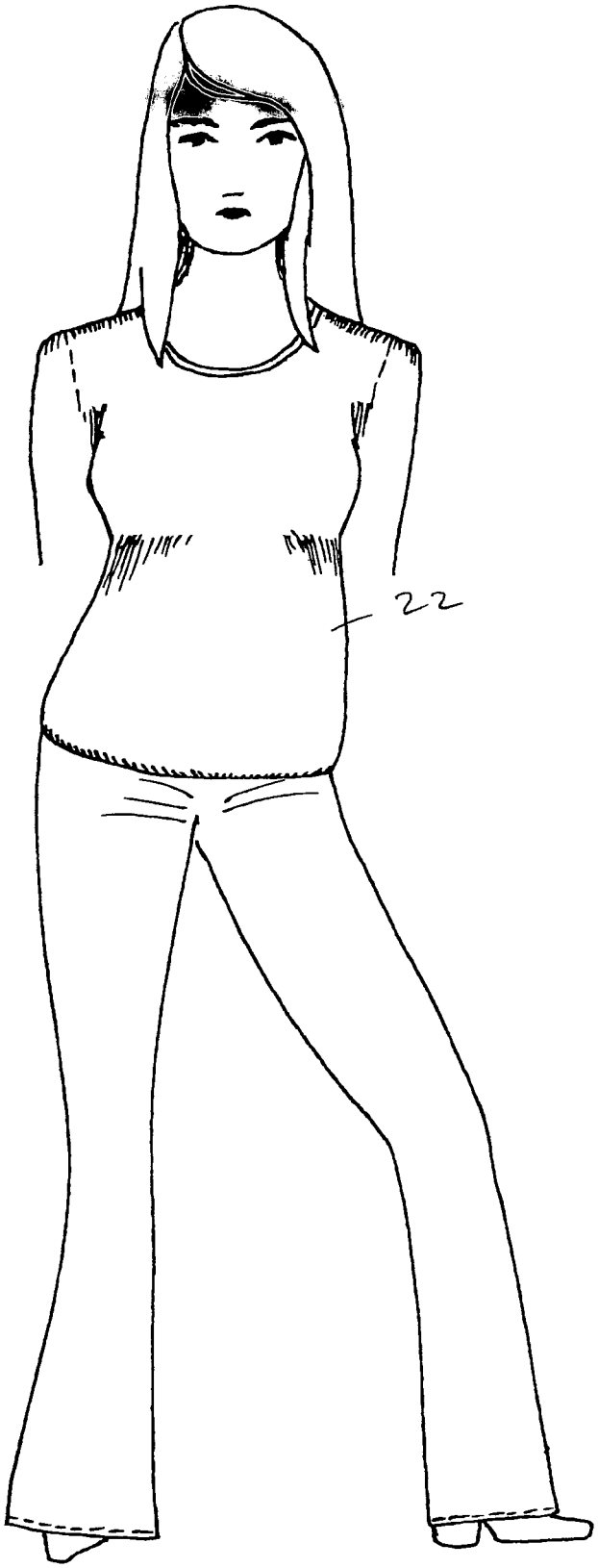
FIG. 7B is another view similar to FIG. 7, but showing a top covering the band garment of the invention.

FIG. 7 shows the woman 12 wearing the same oversized maternity pants or skirt 24, but also wearing the band garment 10 of the invention. As is the case with open-waisted pants or skirt, the garment band 10 firmly but comfortably holds the fabric closely against the woman's body and avoids any awkward appearance. FIG. 7B shows the same woman wearing a top 22 down over the band garment. The result is a very neat and tidy appearance, not hiding the fact of pregnancy but giving the clothes the appearance of a very good fit and also providing for considerable further expansion of the belly.

Figure 7C:
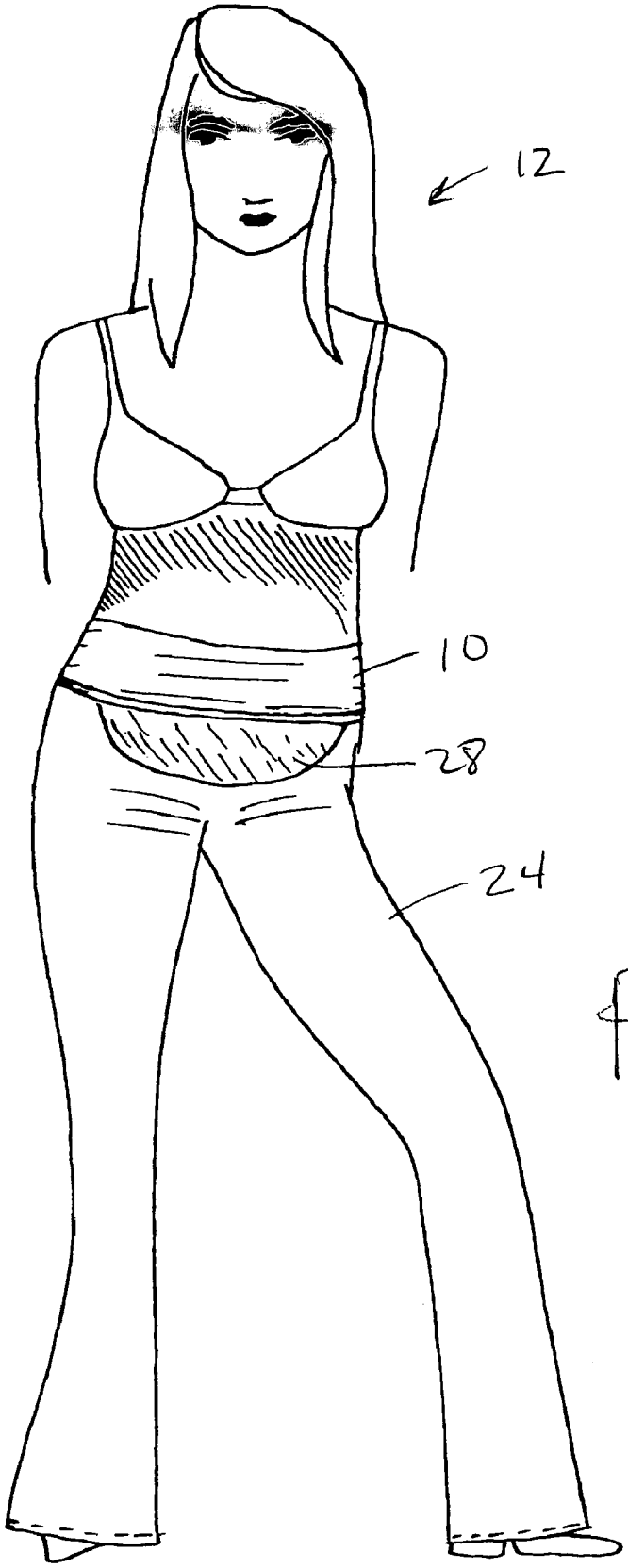
FIG. 7C is a view similar to FIG. 7, but showing the band garment folded into a doubled configuration, halving the height as worn.

FIG. 7C shows the woman as in FIG. 7, but with the band garment 10 folded so as to double it in half, slightly increasing tension and providing an additional layer to help conceal excess fabric, in this case, or an unzipped upper edge of the pants or skirt, in that case. In some cases the wearer may prefer the reduced height of the band garment.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A method for accommodating changes in the shape of a woman during pregnancy without the need for a series of different-sized maternity clothes, comprising:

providing a band of flexible, stretchable material, generally cylindrical in shape and in a size so as to be expanded and stretched to be worn around a pregnant woman's torso approximately at the waist, and the pregnant woman's wearing the band stretched over pants or a skirt which has become too tight to accommodate the swelling of pregnancy, by wearing the pants or skirt unfastened at an upper end, and stretching and placing the band over an upper portion and upper edge of the pants or skirt such that the band covers the unfastened upper end, whereby the band holds the upper end of the pants or skirt closely against the torso, retaining the pants or skirt in place and providing a neat, fitted appearance without lumpiness.

2. The method according to claim 1, wherein the band is worn such that most of the height of the band resides over the pants or skirt, while an upper portion of the height of the band extends above the upper edge of the pants or skirt and engages against the torso.

3. The method according to claim 1, further including the woman's wearing a top having a bottom or tail end, which is positioned to overlap and cover the band.

4. The method according to claim 1, wherein the band is folded upon itself and doubled in thickness as worn over the pants or skirt.

5. A method for a pregnant woman to adapt to the changes of body shape during pregnancy without the need to wear progressively larger maternity clothing, comprising:

providing a band garment of flexible, stretchable fabric, generally cylindrical in shape and in a size so as to be expanded and stretched to be worn with tension around a pregnant woman's body approximately at the waist, and the pregnant woman's wearing the band garment stretched over a skirt or pants comprising a maternity garment which is too large at the waist, loose and non-engaging of the woman's belly at an upper end of the skirt or pants, to hold the skirt or pants in place on the women's body. by stretching and placing the band over an upper portion and upper edge of the pants or skirt so as to flatten such upper edge against the woman's body, the band garment holding the too-large upper end of the pants or skirt closely against the body and providing a neat, fitted appearance.

6. The method according to claim 5, wherein the band is worn such that most of the height of the band resides over the pants or skirt, while an upper portion of the height of the band extends above the upper edge of the pants or skirt and engages against the body or underclothing.

7. A method for a pregnant woman to adapt to the changes of body shape during pregnancy without the need to wear progressively larger maternity clothing, comprising:

providing a band garment of flexible, stretchable fabric, generally cylindrical in shape and in a size so as to be expanded and stretched to be worn with tension around a pregnant woman's body approximately at the waist, and the pregnant woman's wearing the band garment stretched over a skirt or pants which are loose and non-engaging of the woman's belly at an upper end of the skirt or pants, to hold the skirt or pants in place on the women's body, by stretching and placing the band over an upper portion and upper edge of the pants or skirt so as to flatten such upper edge against the woman's body, the band garment being folded over on itself, with the thickness of the band garment doubled, as worn over the upper portion and upper edge of the pants or skirt.

8. A method for accommodating changes in the shape of a woman during pregnancy without the need for a series of different-sized maternity clothes, comprising:

providing a band of flexible, stretchable material, generally cylindrical in shape and in a size so as to be expanded and stretched to be worn around a pregnant woman's torso firmly but comfortably approximately at the waist, and the pregnant woman's wearing the band stretched over normal pre-pregnancy pants or a skirt which has become too tight to accommodate the swelling of pregnancy, by wearing the pants or skirt unfastened at an upper end, and stretching and placing the band over an upper portion and upper edge of the pants or skirt so as to cover the unfastened upper end of the pants or skirt, and wearing the band throughout much of the woman's pregnancy, during transition of early pregnancy and continuing in a period of time when she cannot wear her normal pre-pregnancy clothing and is too small to fill maternity clothing, whereby the band holds the upper end of the pants or skirt closely against the torso, retaining the pants or skirt in place and providing a neat, fitted appearance without lumpiness, enabling the woman to wear her pre-pregnancy clothing through much of her pregnancy.

9. The method according to claim 8, wherein the band is worn such that most of the height of the band resides over the pants or skirt, while an upper portion of the height of the band extends above the upper edge of the pants or skirt and engages against the body.

10. The method according to claim 8, wherein the band extends down sufficiently to hide the fact that the pants or skirt are unfastened.

11. The method according to claim 8, wherein the band is folded upon itself and doubled in thickness as worn over the pants or skirt.

12. The method according to claim 8, further including, following the woman's wearing the band over pre-pregnancy pants or skirt, the woman's wearing oversized maternity pants or skirt which the woman's pregnant belly does not yet fill, with the band stretched over an upper end of the maternity skirt or pants which are loose and non-engaging of the woman's belly at the upper end, to hold the skirt or pants in place on the woman's body.

13. A method for a pregnant woman to adapt to the changes of body shape during pregnancy without the need to wear progressively larger maternity clothing, comprising:

providing a band garment of flexible, stretchable fabric, generally cylindrical in shape and in a size so as to be expanded and stretched to be worn with tension around a pregnant woman's body approximately at the waist, to fit firmly but comfortably, and the pregnant woman's wearing the band garment stretched over a skirt or pants comprising a maternity garment which is too large at the waist, loose and non-engaging of the woman's belly at an upper end of the skirt or pants, to hold the skirt or pants in place on the woman's body, by stretching and placing the band over an upper portion and upper edge of the pants or skirt so as to flatten such upper edge against the woman's body, the band garment holding the oversized upper end of the pants or skirt closely against the body and providing a neat, fitted appearance, and wearing the band throughout much of the woman's pregnancy, during a period of time when she cannot wear her normal pre-pregnancy clothing and is too small to fill maternity clothing.

14. The method according to claim 13, wherein the band is worn such that most of the height of the band resides over the pants or skirt, while an upper portion of the height of the band extends above the upper edge of the pants or skirt and engages against the body or underclothing.

15. A method for a pregnant woman to adapt to the changes of body shape during pregnancy without the need to wear progressively larger maternity clothing, comprising:

providing a band garment of flexible, stretchable fabric, generally cylindrical in shape and in a size so as to be expanded and stretched to be worn with tension around a pregnant woman's body approximately at the waist, and the pregnant woman's wearing the band garment stretched over a skirt or pants which are loose and non-engaging of the woman's belly at an upper end of the skirt or pants, to hold the skirt or pants in place on the women's body, by stretching and placing the band over an upper portion and upper edge of the pants or skirt so as to flatten such upper edge against the woman's body, the band garment being folded over on itself, with the thickness of the band garment doubled, as worn over the upper portion and upper edge of the pants or skirt.

* * * * *